US007733288B2

(12) United States Patent
Williams

(10) Patent No.: US 7,733,288 B2
(45) Date of Patent: Jun. 8, 2010

(54) PASSIVE ANTI-JAMMING ANTENNA SYSTEM AND METHOD

(75) Inventor: Stanley F. Williams, Fredericksburg, VA (US)

(73) Assignee: Microwave Mitigation and Detection ("MMAD"), Richmond, VA (US)

( * ) Notice: Subject to any disclaimer, the term of this patent is extended or adjusted under 35 U.S.C. 154(b) by 240 days.

(21) Appl. No.: 12/078,434

(22) Filed: Mar. 31, 2008

(65) Prior Publication Data

US 2009/0040127 A1 Feb. 12, 2009

Related U.S. Application Data

(60) Provisional application No. 60/920,778, filed on Mar. 30, 2007.

(51) Int. Cl.
*H01Q 1/52* (2006.01)

(52) U.S. Cl. ..... 343/841; 343/833; 343/851; 342/368

(58) Field of Classification Search ..... 343/851, 343/817, 833, 834; 342/368
See application file for complete search history.

(56) References Cited

U.S. PATENT DOCUMENTS 5,294,930 A * 3/1994 Li ..... 342/13
6,229,999 B1 * 5/2001 Reits ..... 455/280
6,337,661 B1 * 1/2002 Kondoh et al. ..... 343/700 MS
6,917,344 B2 * 7/2005 Zimmerman et al. ..... 343/841
6,940,466 B2 * 9/2005 Terry ..... 343/841
6,992,643 B2 1/2006 Fox et al.
7,411,557 B2 * 8/2008 Shimizu et al. ..... 343/702

OTHER PUBLICATIONS

"Anti-Jamming Antenna." *Radio Free Asia*. Jan. 24, 2007. <http://www.rfa.org/english/support/antijamming>.

Brook, Tom Vanden. "Signals foil IEDs but also troop radios." *USA Today*. Jan. 24, 2007. <http://usatoday.printthis.clickability.com/pt/cpt?action=cpt&title= Signals+foil+IEDs+but+...>.

Motorola XTS 1500—Antenna. Dec. 28, 2006. <http://www.motorola.com/governmentandenterprise/northamerica/enus/public/functions/...>.

* cited by examiner

*Primary Examiner*—Tho G Phan
(74) *Attorney, Agent, or Firm*—Dowell & Dowell, P.C.

(57) ABSTRACT

A tunable passive anti-jamming antenna array system and method for minimizing the effects of electromagnetic interference in radio frequency antenna systems. The system and method utilize an external array of passive open circuited antennas strategically arranged between an intended receiving antenna unit and interfering signals to disrupt the interference signals and reduce the electromagnetic energy, interference, and noise reaching the intended receiving antenna unit.

20 Claims, 9 Drawing Sheets

PASSIVE ANTI-JAMMING ANTENNA SYSTEM AND METHOD

CROSS-REFERENCE TO RELATED APPLICATION(S)

This application claims priority to U.S. provisional patent application No. 60/920,778, filed on Mar. 30, 2007, entitled "Passive Anti-Jamming Antenna System," and the contents of which are hereby incorporated by reference in their entirety.

FIELD OF THE INVENTION

The present invention is generally directed to antenna systems. More specifically, the present invention is directed to passive electromagnetic interference suppression or anti-jamming antenna systems, and the methods to suppress, resist, or reduce electromagnetic interference.

BACKGROUND

Radio frequency (RF) jamming, i.e., intentional or unintentional RF interference, occurs when RF power is transmitted so as to interfere with the reception and interpretation of an RF receiving system and in some cases permanently damage the electronics within the receiving antenna unit. Jamming signals may interfere with or terminate the operation of receivers specifically satellite receivers such as navigation, communication, and global navigation satellite system (GNSS), such as global positioning system (GPS) receivers. In this sense, electromagnetic interference (EMI) generally, and jamming in particular, is considered countermeasures to the intended utilization of RF antenna-receiver systems.

A number of techniques have been developed to mitigate the deleterious effects of EMI on RF antenna-receiver systems. These techniques typically employ additional internal antenna hardware components some having mathematically based software programs to minimize EMI. As a result of the additional hardware and software required by the conventional anti-jamming systems, the conventional system are costly to develop and operate. Thus, there is a need for a more cost-effective and efficient system for mitigating the effects of EMI on RF antenna-receiver systems.

SUMMARY

The present invention is directed to a passive system for minimizing the effects of EMI in RF systems. This invention employs an external array of passive open circuited antennas strategically arranged around an intended receiving antenna unit to disrupt intentional or unintentional interference signals and reduce the electromagnetic energy, interference, and noise reaching the intended receiving antenna unit. As a result of the use of passive antennas to mitigate EMI, the present invention is more energy efficient and cost effective than conventional anti-jamming systems.

The present system can also include remote control adjustment capability using servo step motors, computers, and computer software to adjust passive open circuited antenna positions, passive open circuited antenna element heights, and intended antenna-receiver height all to achieve best mode of operation and performance. The system can also utilize automatic signal strength and bit error rate (BER) detection algorisms to automatically sense poor values for each and automatically adjust passive open circuited antenna positions, passive open circuited antenna element height, intended receiving antenna unit height, and antenna system base rotation to obtain straightest possible angle of incidence for the direction of the incoming undesired EMI signal to the intend receiving antenna unit to enhance operation, performance, and interference signal reduction and suppression.

The present invention likewise utilizes a method of interference suppression, resistance, reduction, and potential antenna electronics damage of an existing RF antenna-receiver system by passively disrupting the interfering signal path to the intended receiving antenna unit. In this way, the present method passively mitigates the impact of the intentional or unintentional RF jamming and interference before reaching the intended receiving antenna unit.

Further, the system and method of the invention can be combined with other internal antenna system designs and interference mitigation methods such as RF filters, adaptive antenna system countermeasure techniques referred to as controlled reception pattern antenna (CRPA) arrays or fixed reception pattern antenna (FRPA) arrays, and passive prescreening of the RF energy incident upon a receiving antenna as described in U.S. Pat. No. 6,992,643, any combination of which could result in even greater interference suppression or resistance.

BRIEF DESCRIPTION OF THE DRAWINGS

A better understanding of the invention will be had with reference to the attached drawings wherein.

DETAILED DESCRIPTION OF THE DRAWINGS

The present invention is directed to a system and method for improving EMI suppression, resistance, reduction, or potential antenna electronics damage of an antenna-receiver system through an arrangement of passive open circuited antennas surrounding an intended receiving antenna unit that is to be protected. The system and method involve utilizing an array of passive open circuited antennas placed close to and surrounding a intended receiving antenna unit so that the passive open circuited antennas disrupt an incoming interference signal. As a result, the electromagnetic energy, interference, and noise received by the intended receiving antenna unit is reduced.

In addition to reducing EMI and noise reduction, the present invention results in an increase in desired signal quality and signal strength where the original undisturbed or interference free desired signal is weak (e.g. satellite signals). In other words, by reducing the EMI and noise in the frequency band of the intended receive signal, the original undisturbed satellite signal is partially restored and an increase in satellite signal is achieved.

Figure 1:
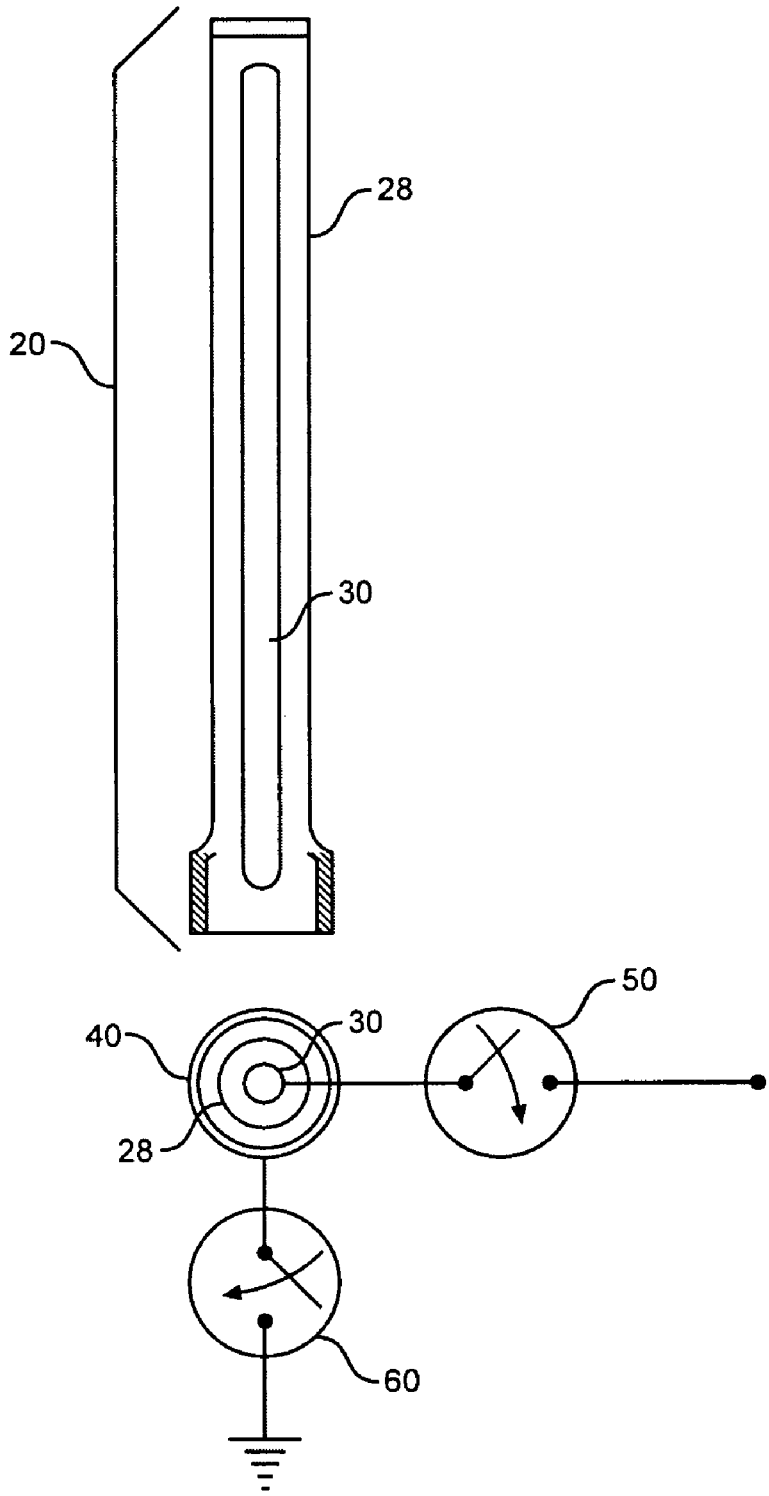
FIG. 1 shows a passive open circuited antenna and electrical connections for a passive open circuited antenna center conductor and outer shield for use with the present invention.

FIG. 1 shows one possible type of passive open circuited antenna 20 for use with the present anti-jamming system and method. The antenna includes an outer plastic jacket 28, electrical connections 50 and 60, a center conductor 30, and an outer shield 40. However, any suitable type of passive open circuited antenna or passive system may be used, such as helix, di-pole, rod, whip, or stubby antennas.

Figure 2:
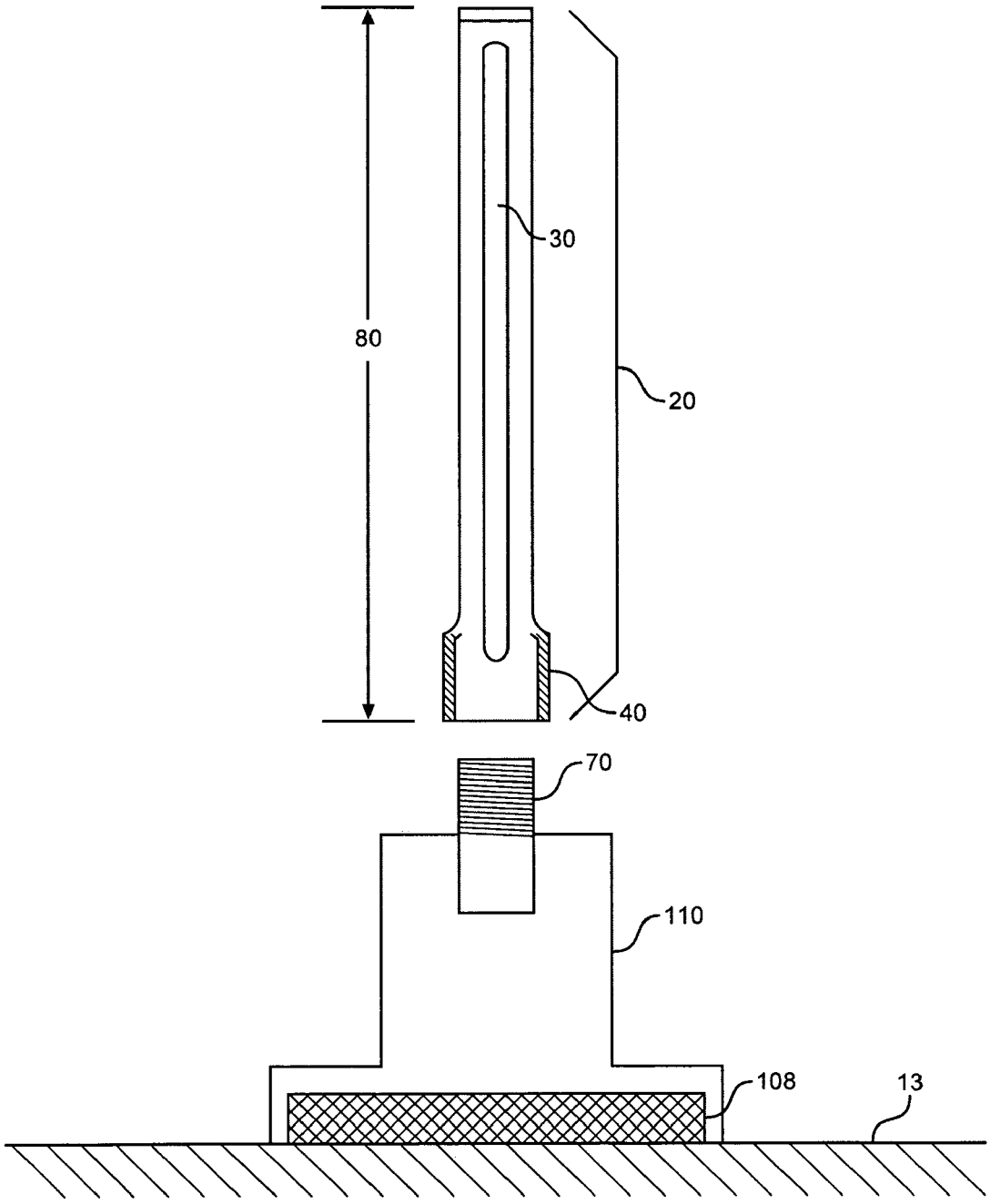
FIG. 2 shows a passive open circuited antenna and a magnetic mounting bracket for the passive antenna for use with the present invention.

FIG. 2 shows the passive open circuited antenna 20 attached to a magnetic mounting bracket base 110 having an incased magnet 108. The magnetic mounting bracket 110 allows the passive open circuited antenna 20 to be easily moved around an intended receiving antenna unit 10 that may be installed on steel or similar surface ground plane material 13 to identify and achieve best location and performance for EMI reduction or suppression. The magnetic 108 also improves the performance of the anti-jamming system.

Figure 3:
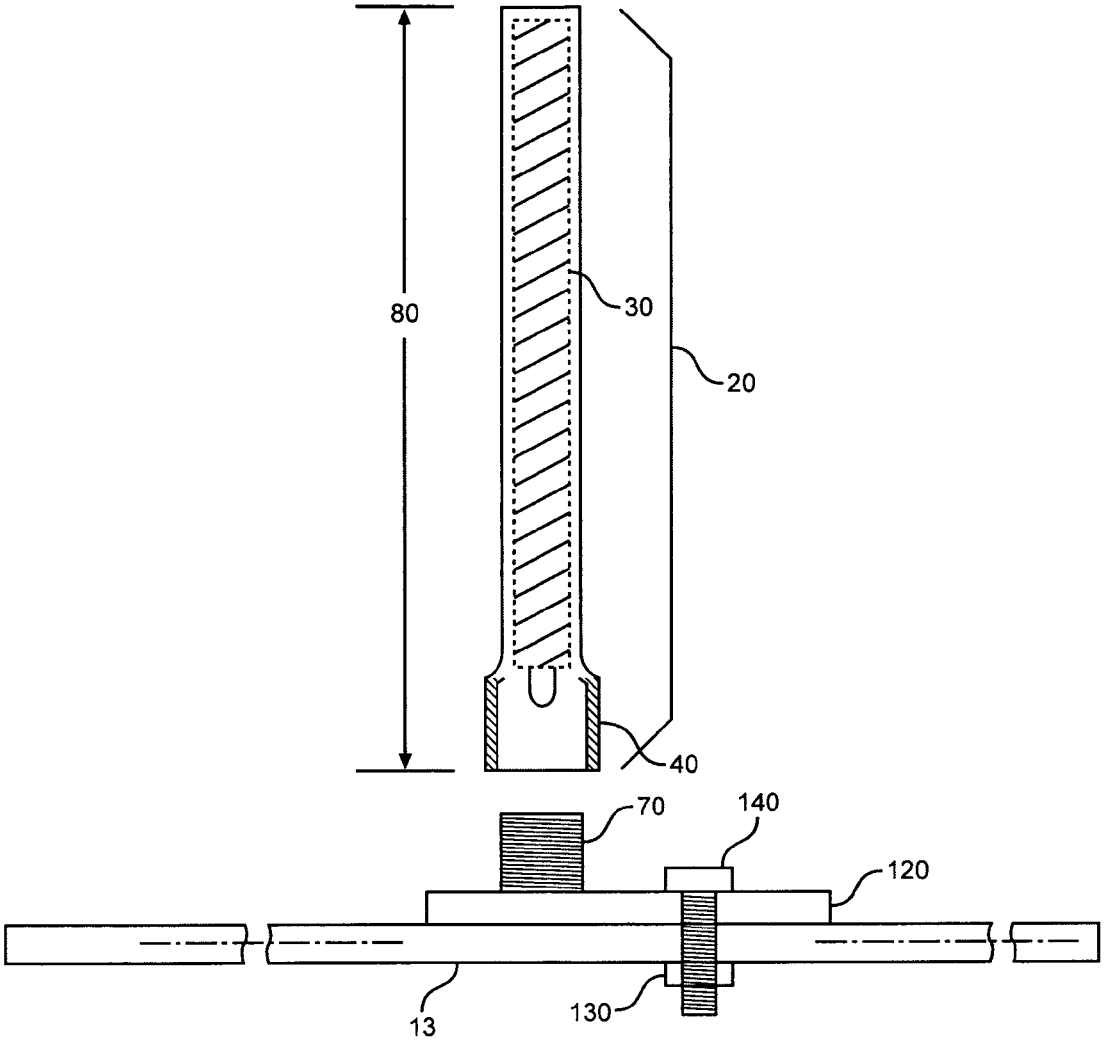
FIG. 3 shows a passive open circuited antenna and a permanent or hard mounting arrangement for mounting the passive open circuited antenna to a ground or surface plane.

As an alternative or in addition to the moveable mounting arrangement shown in FIG. 2, the anti-jamming system and method may use a permanent or hard mounting arrangement for securing each passive open circuited antenna 20. FIG. 3 shows the passive open circuited antenna 20 of length 80, mounted to permanent or hard mounting arrangement bracket 120 at an attachment point 70. The antenna 20 is secured to the bracket 120 by mounting hardware 130 and 140. As an alternative or in addition to the depicted permanent bracket 120, any suitable mounting arrangement or mounting hardware may be used.

Figure 4:
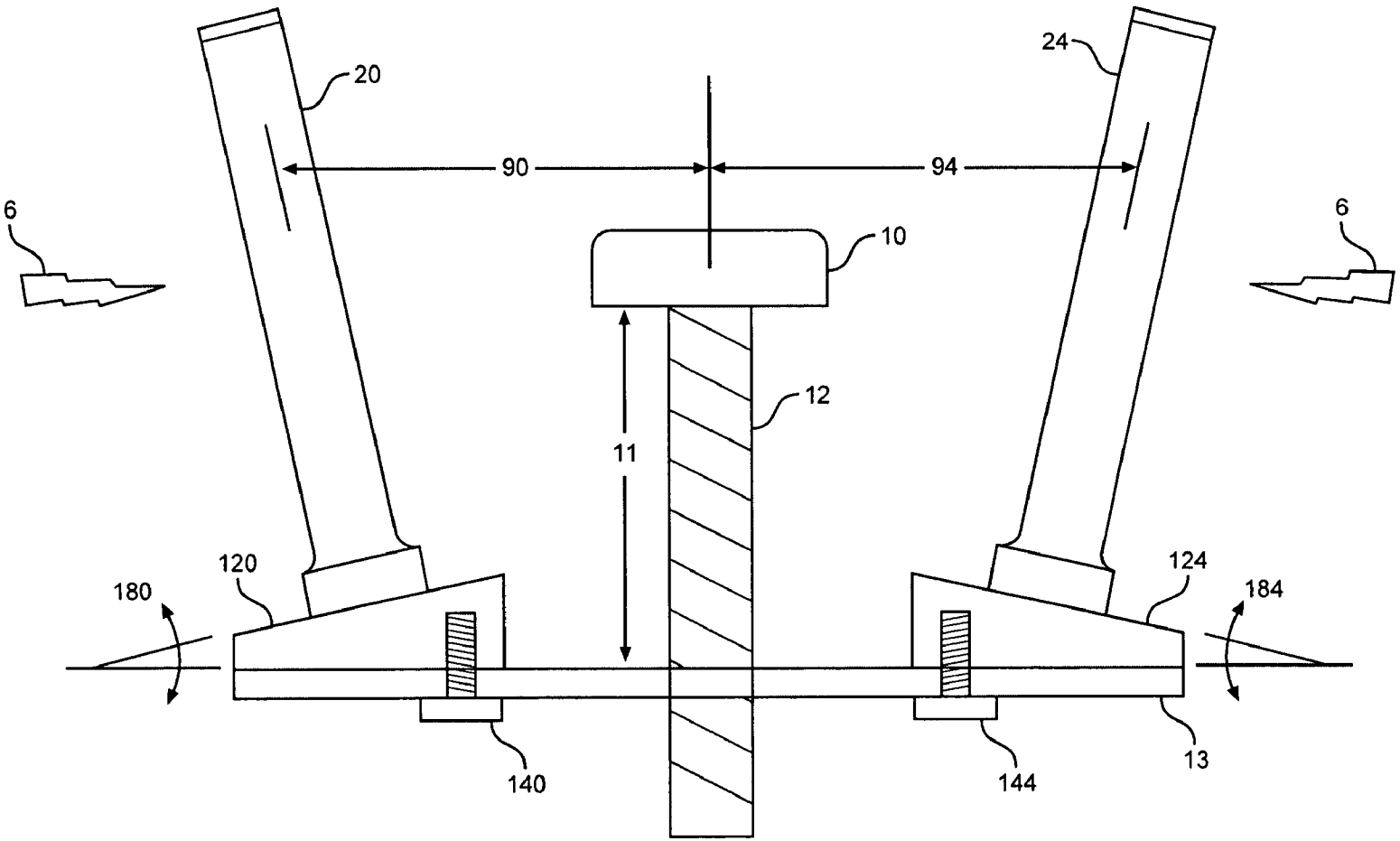
FIG. 4 shows a permanent or hard mounting arrangement for two passive open circuited antennas at a specified distance and angle from the intended receiving antenna unit.

Another mounting arrangement for securing passive open circuited antennas 20 and 24 is shown in FIG. 4. The passive open circuited antennas 20 and 24 are attached to permanent or hard mounting brackets 120 and 124 and mounting bracket hardware 140 and 144, respectively, to the electrical ground plane level 13. The intended receiving antenna 10 is attached to an adjustable slide pole 12 located between the passive open circuited antennas 20 and 24. The intended receiving antenna is spaced a distance 11 from the ground level 13. Preferably, the distance 11 is greater than or equal to the distance between a bottom of each of the passive open circuited antennas 20 and 24 and the electrical ground plane level 13.

The antennas are preferably positioned between interfering signals 6 and the intended receiving antenna 10. Specifically, the antennas 20 and 24 are positioned so that centers of the antennas 20 and 24 are spaced distances 90 and 94, respectively, from a center of the intended receiving antenna unit 10. The antennas 20 and 24 are also tilted toward the interfering signals 6 at tilt angles 180 and 184, respectively, relative to an electrical ground plane level 13.

Figure 5:
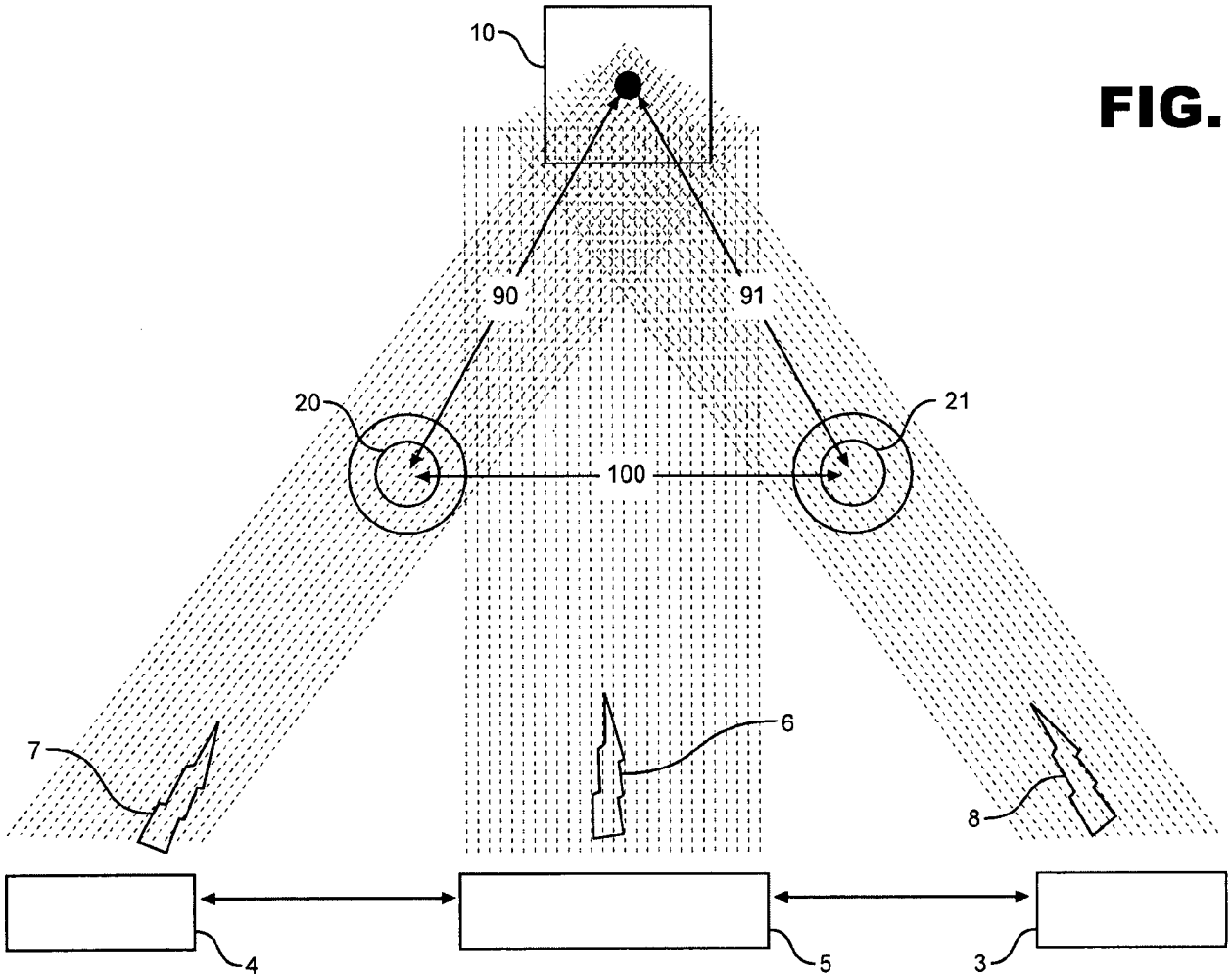
FIG. 5 shows an anti-jamming system utilizing two passive open circuited antennas placed close together and directly between an interfering signal and an intended receiving antenna unit to form an isosceles triangle in accordance with the present invention.

A preferred anti-jamming system for suppressing, resisting, or reducing intentional or unintentional RF jamming and interference energy 6 is depicted in FIG. 5. The system includes two passive open circuited antennas 20 and 21 placed directly between an interference signal source 5 and an intended receiving antenna unit 10. The passive antennas 20 and 21 are positioned so that centers of the antennas 20 and 21 are spaced distances 90 and 91, respectively, from a center of the intended receiving unit 10 so as to form an isosceles triangle with the receiving unit 10. In this arrangement, the system provides enhanced reduction or suppression of the interference energy 6.

Further, even though the passive open circuit antennas 20 and 21 are not placed directly between the intended receiving antenna unit 10 and interference sources 3 and 4, but rather are placed at angles relative to the intended receiving unit 10, the system also suppresses or reduces interfering signal energies 7 and 8. As the angles of incident for the interference signals increases either horizontally or vertically relative to the passive open circuited antennas 20 and 21, the EMI reduction or suppression capability gained from the passive antennas 20 and 21 may decrease.

Figure 6:
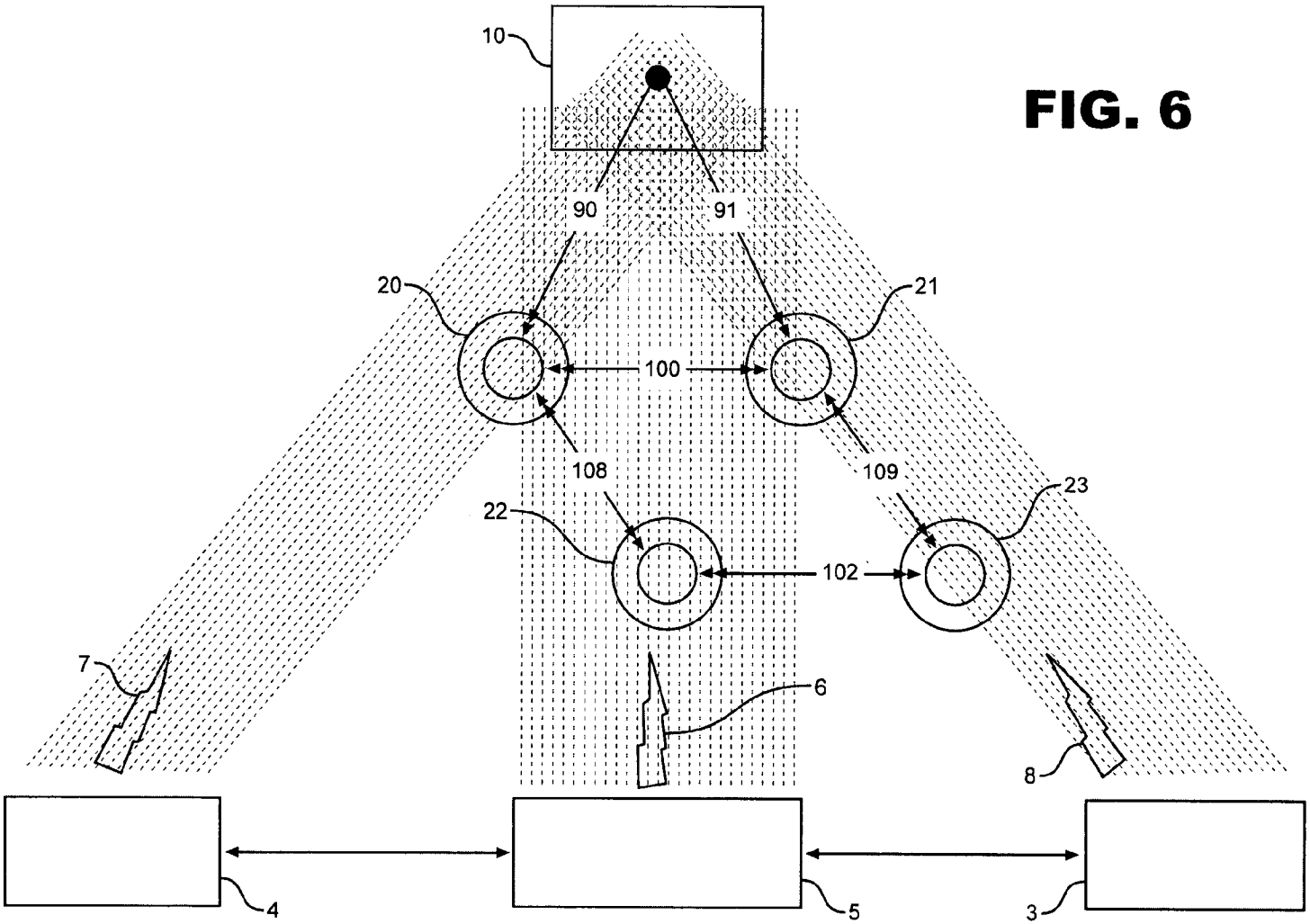
FIG. 6 shows an anti-jamming system utilizing four passive open circuited antennas placed close together and directly between an interfering signal and an intended receiving antenna unit wherein the two passive open circuited antennas form an isosceles triangle with the intended receiving antenna unit and the other passive open circuited antennas form equilateral triangles between each other and are in parallel lines in accordance with an alternate embodiment of the present invention.

An alternative embodiment of the present anti-jamming system for use with severe intentional or unintentional RF jamming is shown in FIG. 6. The anti-jamming system employs four passive open circuited antennas 20, 21, 22, and 23 placed directly between an interference signal source 5 of severe interfering signal 6 and the intended receiving antenna unit 10. While this system uses four passive open circuited antennas, any number of passive sources may be used.

Like the anti-jamming system shown in FIG. 5, the passive antennas 20 and 21 are positioned so that centers of the antennas 20 and 21 are spaced distances 90 and 91, respectively, from a center of the intended receiving unit 10 so as to form an isosceles triangle with the receiving unit 10. The antennas 20, 21, 22, and 23 are also placed so that the centers of the passive antennas 20, 21, 22, and 23 are spaced distances, 101, 102, 108, and 109, relative to each other. As shown in FIG. 6, passive open circuited antennas 20 and 21 are placed in a row parallel to a row containing passive antennas 22 and 23. Further, passive antennas 20 and 22 are positioned in a row parallel to a row containing antennas 21 and 23. In addition, the antennas 20, 21, 22, and 23 are positioned to form two equilateral triangles.

Since the passive antennas 20, 21, 22, and 23 are placed between interference source 5 of the interfering signal 6 and the intended receiving unit 10, the system provides optimal reduction or suppression of the interference energy 6. Further, even though the passive open circuit antennas 20, 21, 22, and 23 are not placed directly between the intended receiving antenna unit 10 and interference sources 3 and 4 or interference signals 7 and 8, respectively, but rather are placed at angles relative to the intended receiving unit 10, the system also provides some suppression or reduction of interfering signal energies 7 and 8.

Figure 7:
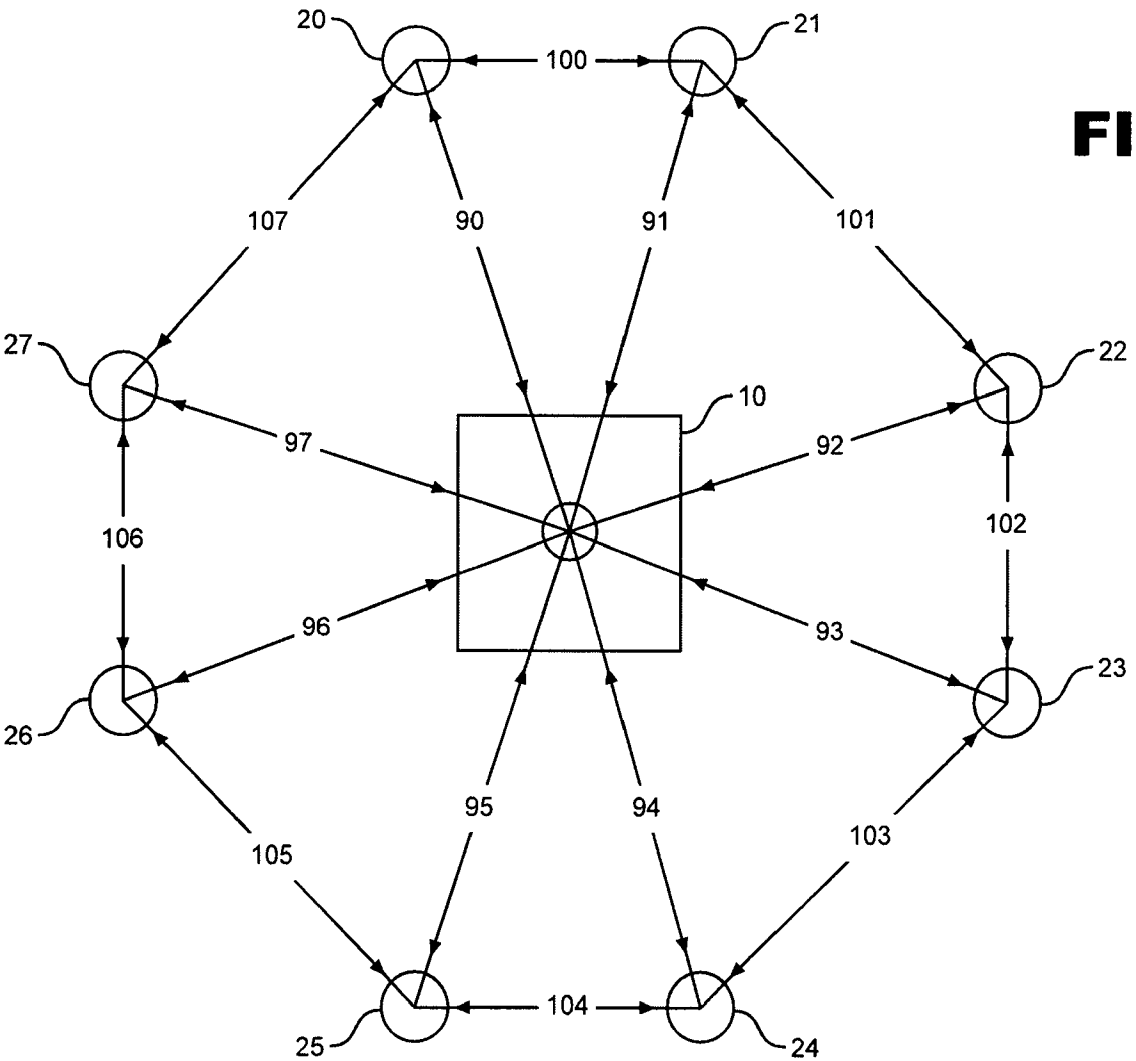
FIG. 7 shows an anti-jamming system utilizing multiple passive open circuited antennas surrounding an intended receiving antenna unit in accordance with another embodiment of the present invention.

Another embodiment of an anti-jamming system is shown in FIG. 7. This system employs multiple passive open circuited antennas 20, 21, 22, 23, 24, 25, 26, and 27 surrounding the intended receiving antenna unit 10. The antennas 20, 21, 22, 23, 24, 25, 26, and 27 are placed so that the centers of the passive antennas 20, 21, 22, 23, 24, 25, 26, and 27 are spaced distances 90, 91, 92, 93, 94, 95, 96, and 97, respectively, from a center of the intended receiving unit 10. The passive antennas 20, 21, 22, 23, 24, 25, 26, and 27 are also positioned at distances 100, 101, 102, 103, 104, 105, 106, and 107 relative to each other, as shown in FIG. 7.

Figure 8:
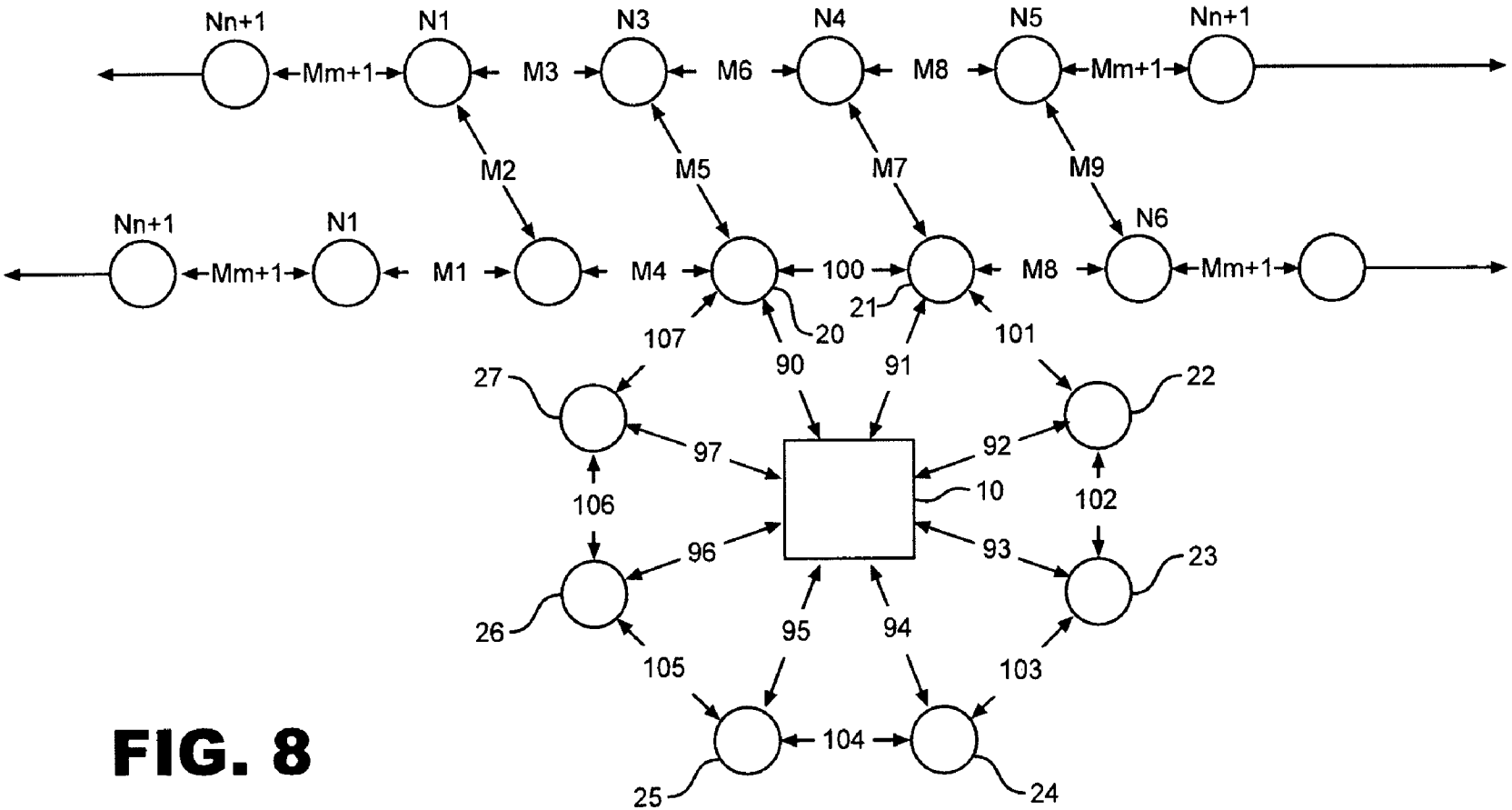
FIG. 8 shows an anti-jamming system utilizing multiple passive open circuited antennas surrounding an intended receiving antenna unit in accordance with another embodiment of the present invention.

A further embodiment of an anti-jamming system is shown in FIG. 8. Similar to the system depicted in FIG. 7, this system also utilizes multiple passive open circuited antennas 20, 21, 22, 23, 24, 25, 26, and 27 surrounding the intended receiving antenna unit 10. The antennas 20, 21, 22, 23, 24, 25, 26, and 27 are placed so that the centers of the passive antennas 20, 21, 22, 23, 24, 25, 26, and 27 are spaced distances 90, 91, 92, 93, 94, 95, 96, and 97, respectively, from a center of the intended receiving unit 10. The passive antennas 20, 21, 22, 23, 24, 25, 26, and 27 are also positioned at distances 100, 101, 102, 103, 104, 105, 106, and 107 relative to each other, as shown in FIG. 8.

This system also includes an additional parallel array of passive open circuited antennas $N_1$, $N_2$, $N_3$, $N_4$, $N_5$, $N_6$, and $N_{n+1}$ which represent a continuing line of passive open circuited antennas for protecting the intended receiving antenna unit 10 in cases of "severe" EMI. These passive antennas $N_1$, $N_2$, $N_3$, $N_4$, $N_5$, $N_6$, and $N_{n+1}$ are separated by distances $M_1$, $M_2$, $M_3$, $M_4$, $M_5$, $M_6$, $M_7$, $M_8$, $M_9$ and $M_{m+1}$, creating parallel lines and equilateral triangles with each other, as shown in FIG. 8.

Figure 10:
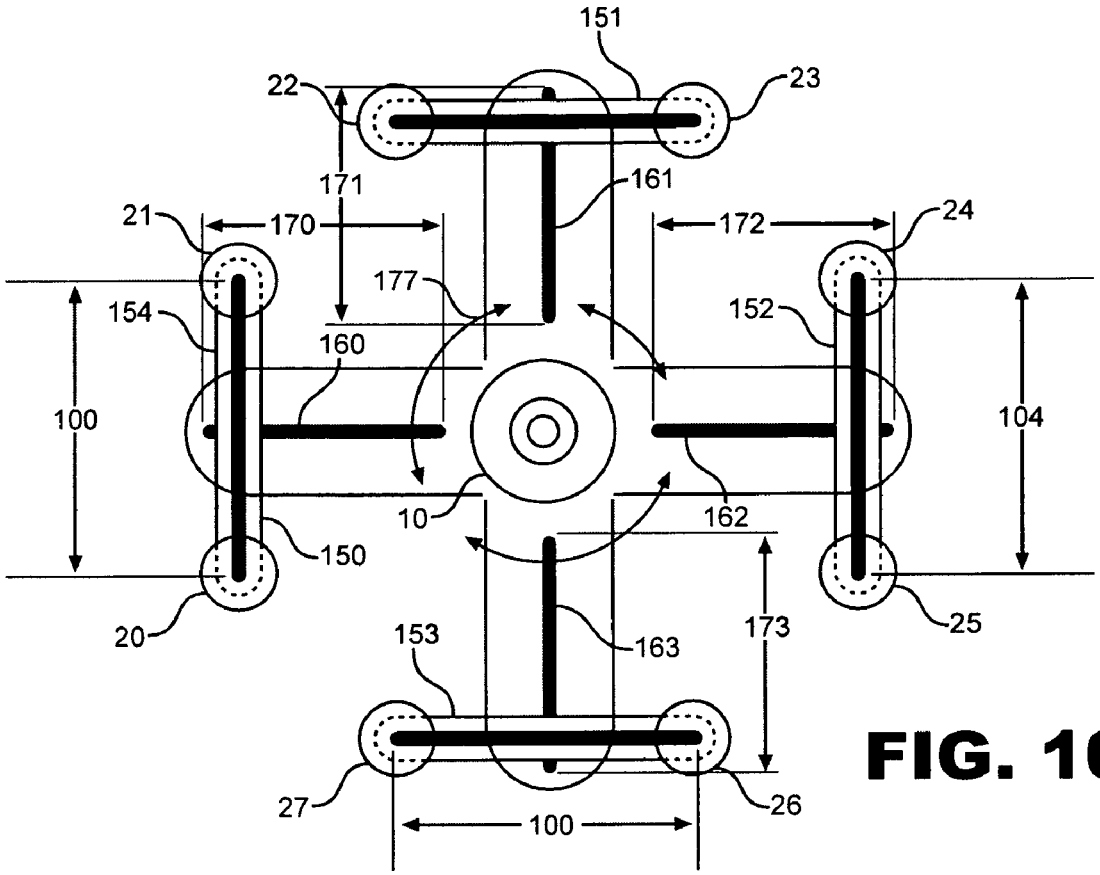
FIG. 10 is a top view of an anti-jamming system utilizing multiple passive open circuited antennas which can each be adjusted relative to each other and to an intended receiving antenna.
Figure 9:
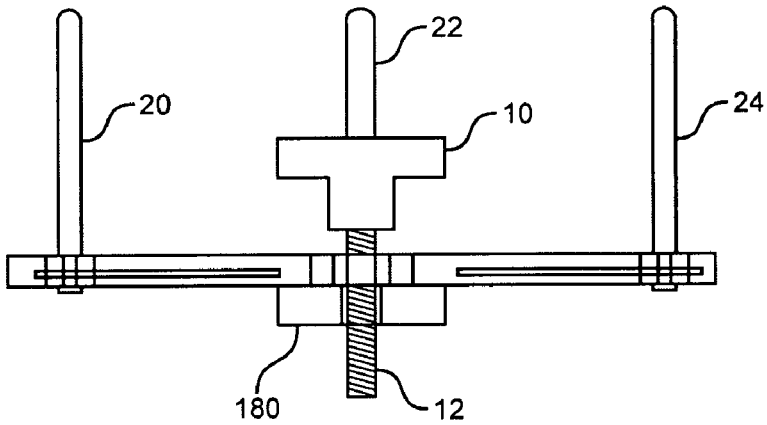
FIG. 9 is a side view of passive open circuited antennas mounted to adjustable slide brackets which are mounted to a common mounting base to allow the open circuited antennas to be adjusted relative to each other and to an intended receiving antenna in accordance with the present invention.

As shown in FIG. 9, passive open circuited antennas can be mounted to adjustable slide brackets which are mounted to a common mounting base to allow the open circuited antennas to be adjusted relative to each other and to the intended receiving antenna 10. An anti-jamming system utilizing passive open circuited antennas mounted to adjustable slide brackets is depicted in FIG. 10. The system includes passive open circuited antennas 20, 21, 22, 23, 24, 25, 26, and 27. The passive antennas 20, 21, 22, 23, 24, 25, 25, 26, and 27 are placed in pairs around the intended receiving antenna 10. The intended receiving antenna unit 10 is mounted to an adjustable slide pole 12 so that a height of intended receiving antenna unit 10 relative to the passive open circuited antennas 20, 21, 22, 23, 24, 25, 26, and 27 may be adjusted.

Each pair of passive open circuited antennas is mounted to separate adjustable slide bracket 151, 152, 153, and 154. Each of the slide brackets 151, 152, 153, and 154 is secured to adjustable slide bracket mounting base 150. Each base 150 includes an adjustable slide slot, and each bracket 151, 152, 153, and 154 slides in an adjustable slide slot 161, 162, 163, and 160, respectively, over an adjustable range of distances 171, 172, 173, and 170, respectively. Further, each bracket mounting base is electrically connected to a servo step motor 180, and the motor 180 can rotate each mounting base 150 360° around the intended receiving unit 10, as shown by arrow 177 in FIG. 10.

To maximize EMI suppression or reduction, the height of the intended receiving antenna unit 10 may be adjusted based on an angle of incidence and direction of an interference signal. The position of the passive open circuited antennas 20, 21, 22, 23, 24, 25, 26, and 27 relative to the intended receiving unit 10 can also be modified via the adjustable slide bracket mounting base 150 to optimize EMI and noise suppression or reduction.

Further, while FIG. 10, shows a four brackets and corresponding slots, any suitable number of brackets and slots may be used. In addition, while FIG. 10 shows a pair of a passive open circuited antennas attached to each bracket, any number of passive antennas may be secured to each bracket.

To further optimize EMI suppression, the following parameters of the ant-jamming system and method of the present invention may also be adjusted: a polarity match between the passive open circuited antennas and the interfering signal source, the height of the intended receiving antenna unit in relationship to the passive open circuited antennas, the number and physical arrangement of passive open circuited antennas surrounding the intended receiving antenna unit, the type of passive open circuited antennas used, the physical or electrical length of the passive open circuited antenna elements, the tilt angle of the passive open circuited antennas in the direction of the interfering signal, the distance between passive open circuited antennas and the intended receiving antenna unit, the distance between each passive open circuited antenna, the power density of the electromagnetic field, and angle of incidence and direction of the incoming undesired electromagnetic interference signal.

The foregoing description of the present invention has been presented to illustrate the principles of the invention and not to limit the invention to the particular embodiments illustrated. It is intended that the scope of the invention be defined by all of the embodiments encompassed within the following claims and their equivalents.

I claim:

1. A passive antenna system for suppressing electromagnetic interference signals comprising:

an electromagnetic energy source;

a receiving antenna electrically connected to a receiver or transceiver for receiving electromagnetic energy from said electromagnetic energy source; and at least one passive open circuited antenna positioned between said receiving antenna and the electromagnetic interference signals, wherein said at least one passive open circuited antenna is not electrically connected to said receiving antenna other than via an electrical ground.

2. The passive antenna system of claim 1, further comprising a plurality of passive open circuited antennas including said at least one passive open circuited antenna positioned between said receiving antenna and the electromagnetic interference signals, wherein said plurality of passive open circuited antennas is not electrically connected to said receiving antenna other than via an electrical ground.

3. The passive antenna system of claim 2, wherein said plurality of passive open circuited antennas are positioned between said receiving antenna and the electromagnetic interference signals so as to form an isosceles triangle with said receiving antenna.

4. The passive antenna system of claim 2, wherein each of said plurality of passive open circuited antennas includes an adjustable base having up to six axes of freedom so that a position of each passive open circuited antenna is adjustable relative to said receiving antenna.

5. The passive antenna system of claim 2, further comprising:

at least one bracket, each attached to at least one passive open circuited antenna of said plurality of passive open circuited antennas; and at least one slot located between said receiving antenna and said plurality of passive open circuited antennas, wherein said at least one bracket is received in said at least one a slot so that said at least one bracket is moveable along a length of said at least one slot to adjust a position of the passive open circuited antenna attached to said at least one bracket relative to said receiving antenna.

6. The passive antenna system of claim 5, wherein each of said plurality of passive open circuited antennas includes an adjustable base so that a position of each passive open circuited antenna is adjustable relative to said receiving antenna.

7. The passive antenna system of claim 6, further comprising a motor for adjusting a position of each passive open circuited antenna relative to said receiving antenna.

8. The passive antenna system of claim 2, wherein said receiving antenna is moveably mounted to a pole so that a distance between said receiving antenna and a ground level is adjustable.

9. A method for suppressing electromagnetic interference signals comprising:

utilizing an electromagnetic energy source and a receiving antenna connected to a receiver or transceiver to transmit electromagnetic signals between the electromagnetic source and the receiver or transceiver; and placing at least one passive open circuited antenna between the receiving antenna and the electromagnetic interference signals, wherein the at least one passive open circuited antenna is not electrically connected to the receiving antenna other than via an electrical ground.

10. The method of claim 9, further comprising placing a plurality of passive open circuited antennas, including the at least one passive open circuited antenna, between the receiving antenna and the electromagnetic interference signals, wherein the plurality of passive open circuited antennas is not connected to the receiving antenna other than via an electrical ground.

11. The method of claim 10, further comprising adjusting the position of each passive open circuited antenna of the plurality of passive open circuited antennas based on angles of incidence and directions of the electromagnetic interference signals.

12. The method of claim 10, further comprising adjusting the position of each passive open circuited antenna of the plurality of passive open circuited antennas based on a wavelength of the electromagnetic energy from the electromagnetic energy source.

13. The method of claim 10, further comprising adjusting the position of each passive open circuited antenna of the plurality of passive open circuited antennas based on wavelengths of the electromagnetic interference signals.

14. The method of claim 10, further comprising adjusting the position of each passive open circuited antenna of the plurality of passive open circuited antennas based on a resonance of each passive open circuited antenna.

15. The method of claim 10, further comprising adjusting the number of passive open circuited antennas included in the plurality of passive open circuited antennas based on an electromagnetic environment.

16. The method of claim 10, further comprising adjusting the number of passive open circuited antennas included in the plurality of passive open circuited antennas based on a power density of an electromagnetic field.

17. The method of claim 10, further comprising adjusting the number of passive open circuited antennas included in the plurality of passive open circuited antennas based on angles of incidence and directions of the electromagnetic interference signals.

18. The method of claim 10, further comprising adjusting a length of each passive open circuited antenna of the plurality of passive open circuited antennas based on a wavelength of the electromagnetic energy from the electromagnetic energy source.

19. The method of claim 10, further comprising adjusting a length of each passive open circuited antenna of the plurality of passive open circuited antennas based on wavelengths of the electromagnetic interference signals.

20. The method of claim 10, further comprising adjusting a polarization of each passive open circuited antenna of the plurality of passive open circuited antennas based on polarities of the electromagnetic interference signals.

* * * * *